US006141944A

United States Patent [19]

Spatafora

[11] Patent Number: 6,141,944

[45] Date of Patent: Nov. 7, 2000

[54] CONTINUOUS PRODUCT WRAPPING METHOD AND MACHINE

[75] Inventor: Mario Spatafora, Bologna, Italy

[73] Assignee: G.D Societa' per Azioni, Bologna, Italy

[21] Appl. No.: 09/263,964

[22] Filed: Mar. 5, 1999

[30] Foreign Application Priority Data

Mar. 5, 1998 [IT] Italy ..... BO98A0129

[51] Int. Cl.[7] ..... B65B 11/28; B65B 19/22

[52] U.S. Cl. ..... 53/466; 53/234; 53/253; 53/579

[58] Field of Search ..... 53/466, 461, 234, 53/232, 228, 252, 251, 250, 249, 225, 253, 579, 578

[56] References Cited

U.S. PATENT DOCUMENTS 4,559,757 12/1985 Focke et al. ..... 53/234 X
5,392,586 2/1995 Imai ..... 53/234
5,822,948 10/1998 Manservigi et al. ..... 53/234 X

FOREIGN PATENT DOCUMENTS 195 02 562 8/1996 Germany .
906 379 9/1962 United Kingdom .
1570605 7/1980 United Kingdom .
2138382 10/1984 United Kingdom .

*Primary Examiner*—James F. Coan
*Attorney, Agent, or Firm*—Klauber & Jackson

[57] ABSTRACT

A method and machine for continuously wrapping a product, whereby a sheet of wrapping material is transferred, from an output of a line for supply wrapping material, into a seat of a wrapping conveyor onto which the sheet of wrapping material, folded into a U, is released by a folding spindle about which the sheet is folded at least partly into a U before being transferred into the seat; the seat and the sheet are then fed through a loading station to receive the product.

21 Claims, 3 Drawing Sheets

CONTINUOUS PRODUCT WRAPPING METHOD AND MACHINE

The present invention relates to a continuous product wrapping method.

In the following description, specific reference is made purely by way of example to the packing of cigarettes, and in particular to the wrapping of a group of cigarettes in a sheet of foil normally having a tear-off top portion, at least part of the edge of which is defined by a preformed tear line.

BACKGROUND OF THE INVENTION

Cigarette packing machines are known to feature a step-operated or continuous wrapping wheel having a number of peripheral seats, each for receiving a respective group of cigarettes—normally comprising twenty cigarettes arranged in three layers—which is fed to a respective seat on the wrapping wheel from a respective seat on a transfer wheel.

Before the group of cigarettes is transferred between the seats on the two wheels, a sheet of foil is fed between the wheels along the transfer path of the group from one wheel to the other, so that, when transferring the group, the sheet is inserted inside the respective seat on the wrapping wheel and simultaneously folded into a U about the group.

U.S. Pat. No. 5,392,586 describes a continuous wrapping unit operating according to the above known method, but which is complex in design and therefore expensive to produce. That is, the continuous movement of the wheels and the continually-changing positions of the seats with respect to each other and to the sheet of wrapping material call for complex mechanical solutions to keep the seats facing each other, and for synchronously inserting the sheet of wrapping material between the seats.

Moreover, regardless of whether the machine is operated continuously or in steps, the above method fails to provide for effectively folding the sheet of foil, on account of the increasingly fast operating speeds of modern packing machines—by now capable of producing over ten packets a second—reducing the folding time per sheet to a few hundredths of a second, and so stressing the sheet as to result in premature partial to total tearing of the tear-off portion.

GB patent application No. 2138382 discloses a continuos cigarette packing machine having a conveyor supporting a plurality of seats, each of which is capable of receiving and conveying a relevant sheet of wrapping material and a respective group of cigarettes. The conveyor feeds each seat through a first loading station, in which the seat receives the relevant sheet of wrapping material, and a successive second loading station, in which the seat receives the relevant product. Each sheet of wrapping material is fed to the relevant seat by a respective folding spindle, which is fed through an output of a line for supplying wrapping material to pick up and fold the sheet of wrapping material at least partly into a U. The folding spindle is then fed through the first loading station to be inserted into the relevant seat for feeding the sheet arranged in a substantially U-folded configuration inside the relevant seat.

In the known packing machine described above, perfect insertion of a folding spindle into a relevant seat for feeding the same with a relevant sheet of wrapping material is very difficult and generally involves some creeping of the external surfaces of the spindle with the internal surfaces of the seat; and this creeping may stress the sheet of wrapping material, which is clamped between the spindle and the seat, and result in a premature partial to total tearing of the tear-off portion.

SUMMARY OF THE INVENTION

It is an object of the present invention to provide a method of continuously wrapping a product in a sheet of wrapping material, designed to eliminate the aforementioned drawbacks, and which, in particular, is straightforward and cheap to implement.

According to the present invention, there is provided a method of continuously wrapping a product, the method comprising the steps of feeding a sheet of wrapping material to an output of a line for supplying wrapping material; coupling said sheet with a folding spindle, about which said sheet is folded at least partly into a U; feeding said folding spindle together with said sheet to a first loading station; inserting, at said first loading station said folding spindle into a seat on a wrapping conveyor for feeding the sheet arranged in a substantially U-folded configuration inside said seat; feeding the seat and the sheet through a second loading station to receive said product; and feeding the seat together with the sheet and the product through at least one folding station to fold said sheet about said product; the method being characterized in that said seat is set in a first open position, in which each of the said lateral walls forms with said bottom wall an obtuse angle, to receive said sheet and said product and in a second closed position, in which each of the said lateral walls forms with said bottom wall a substantially right angle, to hold together said sheet and said product during the folding of the sheet about the product.

The present invention also relates to a machine for continuously wrapping a product.

According to the present invention, there is provided a machine for continuously wrapping a product, the machine comprising a line for supplying wrapping material and having an output; at least one seat for receiving and conveying said sheet of wrapping material and a respective product; a wrapping conveyor carrying said seat and having a first loading station for a sheet of wrapping material, a second loading station for said product, located downstream from said first loading station in a traveling direction of said seat, and at least one folding station to fold said sheet about said product; at least one folding spindle; and first actuating means for feeding the folding spindle through said output to pick up and fold said sheet of wrapping material at least partly into a U about the folding spindle, and then through said first loading station to insert said folding spindle into said seat for feeding the sheet arranged in a substantially U-folded configuration inside said seat; the machine being characterized in that said two lateral walls are rotary connected to said bottom wall; the machine further comprising second actuating means for setting said seat in a first open position, in which each of the said lateral walls forms with said bottom wall an obtuse angle, to receive said sheet and said product and in a second closed position, in which each of the said lateral walls forms with said bottom wall a substantially right angle, to hold together said sheet and said product during the folding of the sheet about the product.

Additional features, which may optionally be used to implement the invention to advantage, are set out in the dependent Claims.

In particular, the additional features set out in claims 3 and 12 allow a very good "U" folding of each sheet in the relevant seat. Furthermore, the additional feature set out in Claim 6 substantially allows canceling residual creeping of the external surfaces of the spindle with the internal surfaces of the seat.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
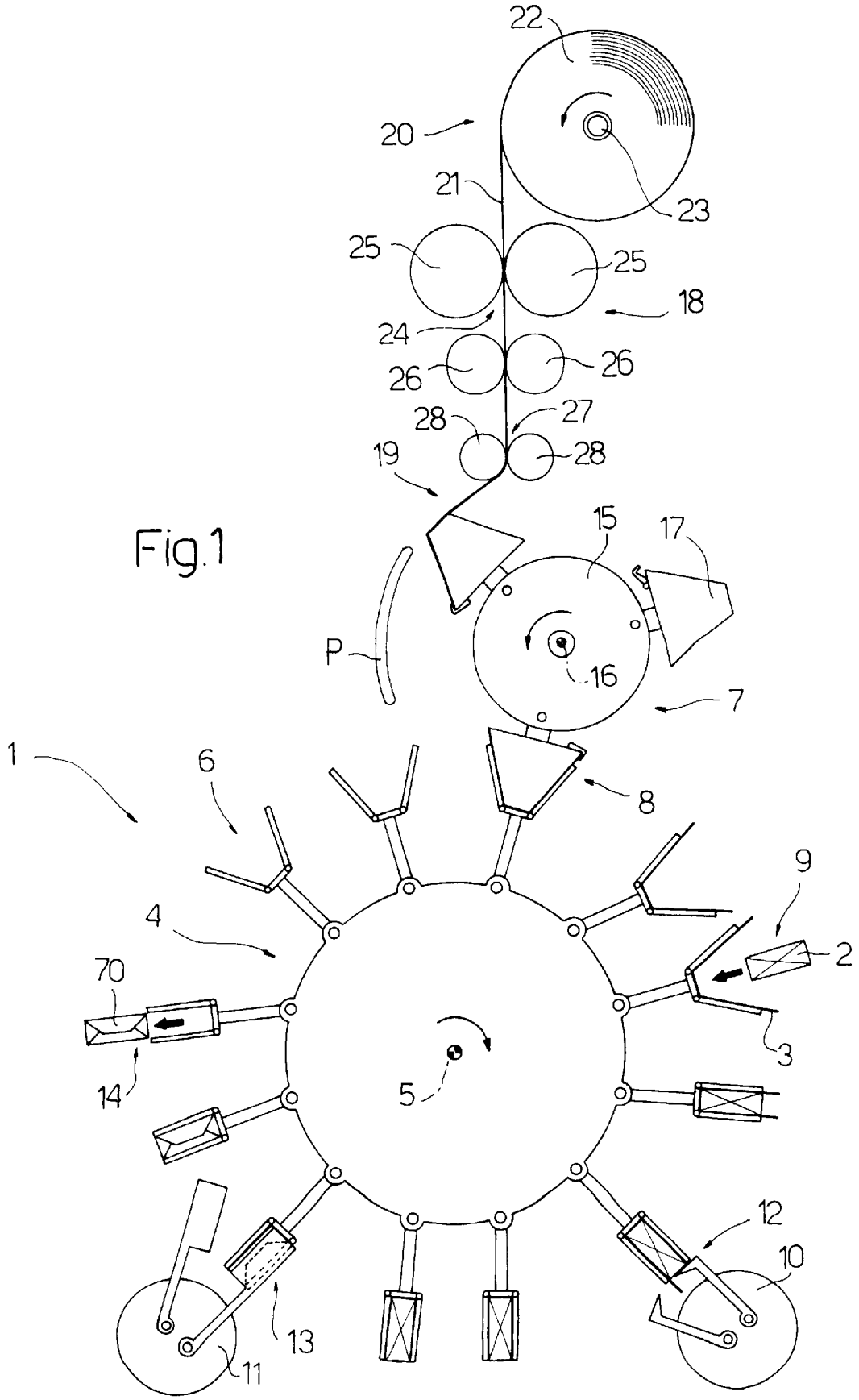
FIG. 1 shows a schematic front view, with parts removed for clarity, of a preferred embodiment of the machine according to the present invention.

Number 1 in FIG. 1 indicates as a whole an automatic packing machine for producing packets of cigarettes (not shown), wherein a group 2 of cigarettes is first wrapped in a sheet 3 of foil wrapping material, and is then inserted inside a blank (not shown) which is folded about group 2 to form a packet of cigarettes (not shown).

Packing machine 1 comprises a wrapping wheel 4 powered to rotate continuously (clockwise in FIG. 1) about a central axis 5 perpendicular to the FIG. 1 plane, and having a number of peripheral seats 6 equally spaced about axis 5. Each seat 6 provides for receiving and conveying first a respective sheet 3 of wrapping material folded substantially into a U, and then also a respective group 2 of cigarettes, which is wrapped in sheet 3 of wrapping material.

Packing machine 1 also comprises a supply device 7 for successively feeding sheets 3 of wrapping material to respective seats 6 on wrapping wheel 4 at a loading station 8; a known loading station 9 where groups 2 of cigarettes are fed successively to respective seats 6 on wrapping wheel 4; two known folding devices 10 and 11 for folding a sheet 3 of wrapping material about a respective group 2 of cigarettes at respective folding stations 12 and 13; and an unloading station 14 where groups 2 wrapped in respective sheets 3 of wrapping material are extracted successively from respective seats 6 on wrapping wheel 4 and fed to successive known wrapping units (not shown).

Supply device 7 comprises a transfer wheel 15 powered to rotate continuously (anticlockwise in FIG. 1) about a central axis 16 parailel to axis 5, and having a number of peripheral folding spindles 17 equally spaced about axis 16. Each folding spindle 17 provides for picking up a respective sheet 3 of wrapping material from a known supply unit 18, at an output of unit 18 defined by a supply station 19, and for feeding sheet 3 of wrapping material to a respective seat 6 at loading station 8.

Supply device 7 also comprises a folding element P located along the path of folding spindles 17 between supply station 19 and loading station 8.

Supply unit 18 comprises a known unwinding station 20 where a strip 21 of foil is unwound off a reel 22 supported on a pin 23; a known embossing station 24 having two embossing rollers 25; two feed rollers 26 for feeding strip 21 along supply unit 18; and a known cutting station 27 having two cutting rollers 28.

Figures 3, 4, 5:
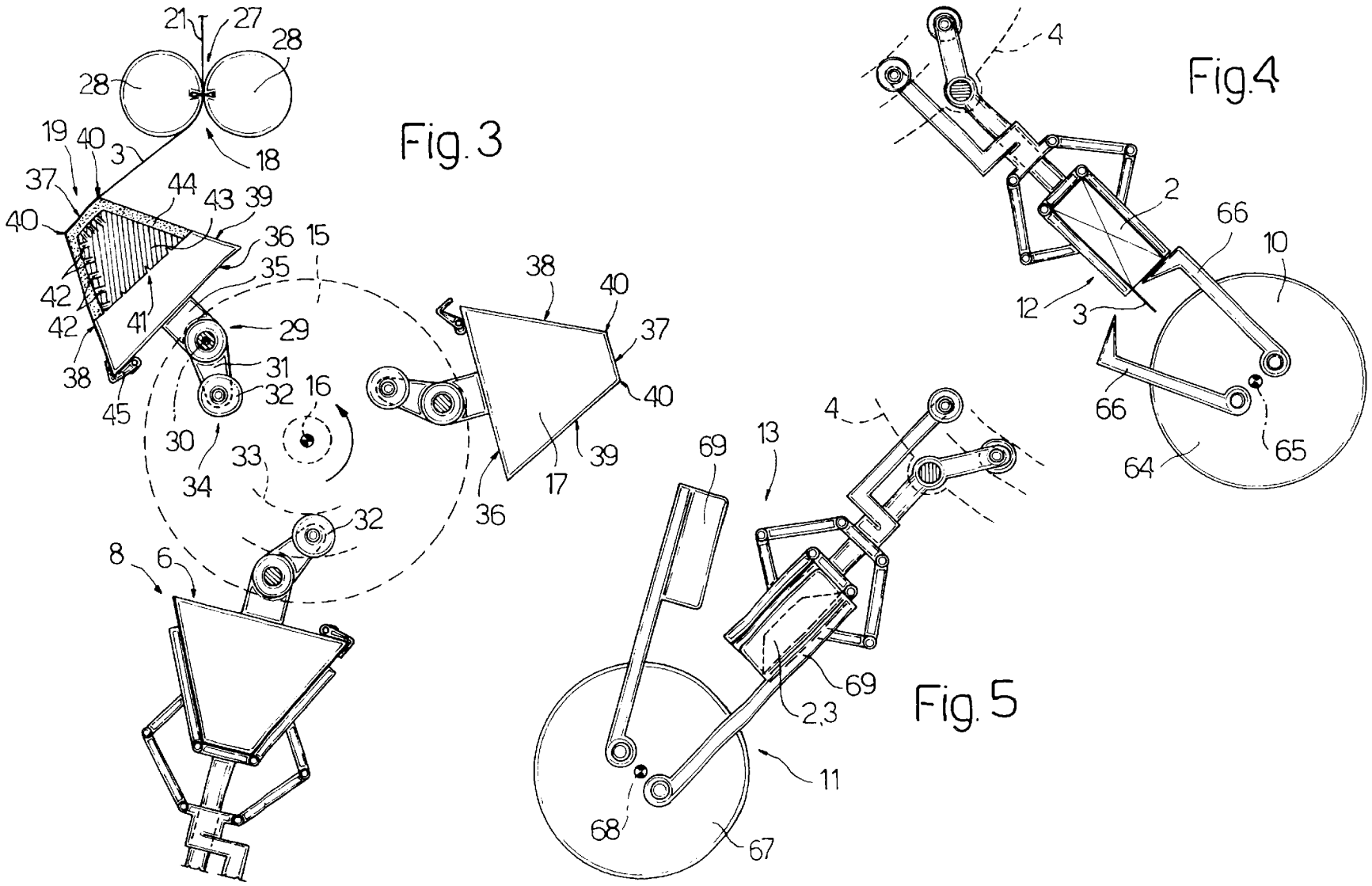
FIG. 3 shows a larger-scale schematic front view of a second detail of the FIG. 1 machine.
FIG. 4 shows a larger-scale schematic front view of a third detail of the FIG. 1 machine.
FIG. 5 shows a larger-scale schematic front view of a fourth detail of the FIG. 1 machine.

As shown more clearly in FIG. 3, folding spindles 17 are connected to transfer wheel 15 via the interposition of respective rocker arms 29, each of which is hinged to transfer wheel 15 to swing, with respect to transfer wheel 15, about an axis 30 parallel to axis 16. Each rocker arm 29 comprises a first arm 31 extending towards axis 16 and fitted on the free end with a tappet roller 32 connected to a fixed cam 33 defining, with roller 32, a control device 34 for controlling the angular position of rocker arm 29 about respective axis 30; and a second arm 35 extending outwards of transfer wheel 15 and fitted on the free end with a respective folding spindle 17.

Each folding spindle 17 is substantially trapezoidal and is defined by a large bottom surface 36 parallel to axis 16, by a small top surface 37 parallel to surface 36 and outwards of surface 36 with respect to axis 16, and by two inclined lateral surfaces 38 and 39 located respectively at the front and rear with reference to the traveling direction of folding spindle 17, and which form, with top surface 37, two edges 40 parallel to axis 16. Each folding spindle 17 is fixed to respective arm 35 at bottom surface 36, and comprises a known pneumatic suction device 41, which comes out through a number of suction holes 42 formed in surfaces 37 and 38 to retain a respective sheet 3 of wrapping material.

Each folding spindle 17 comprises an inner body 43 of nondeformable material, typically metal, covered at surfaces 37, 38 and 39 by a thin outer layer 44 of deformable material, typically rubber or sponge. In an alternative embodiment not shown, folding spindles 17 have no outer layers 44 of deformable material.

Each folding spindle 17 also comprises a gripper 45 hinged to bottom surface 36 to retain a respective sheet 3 of wrapping material on lateral surface 38.

Figure 2:
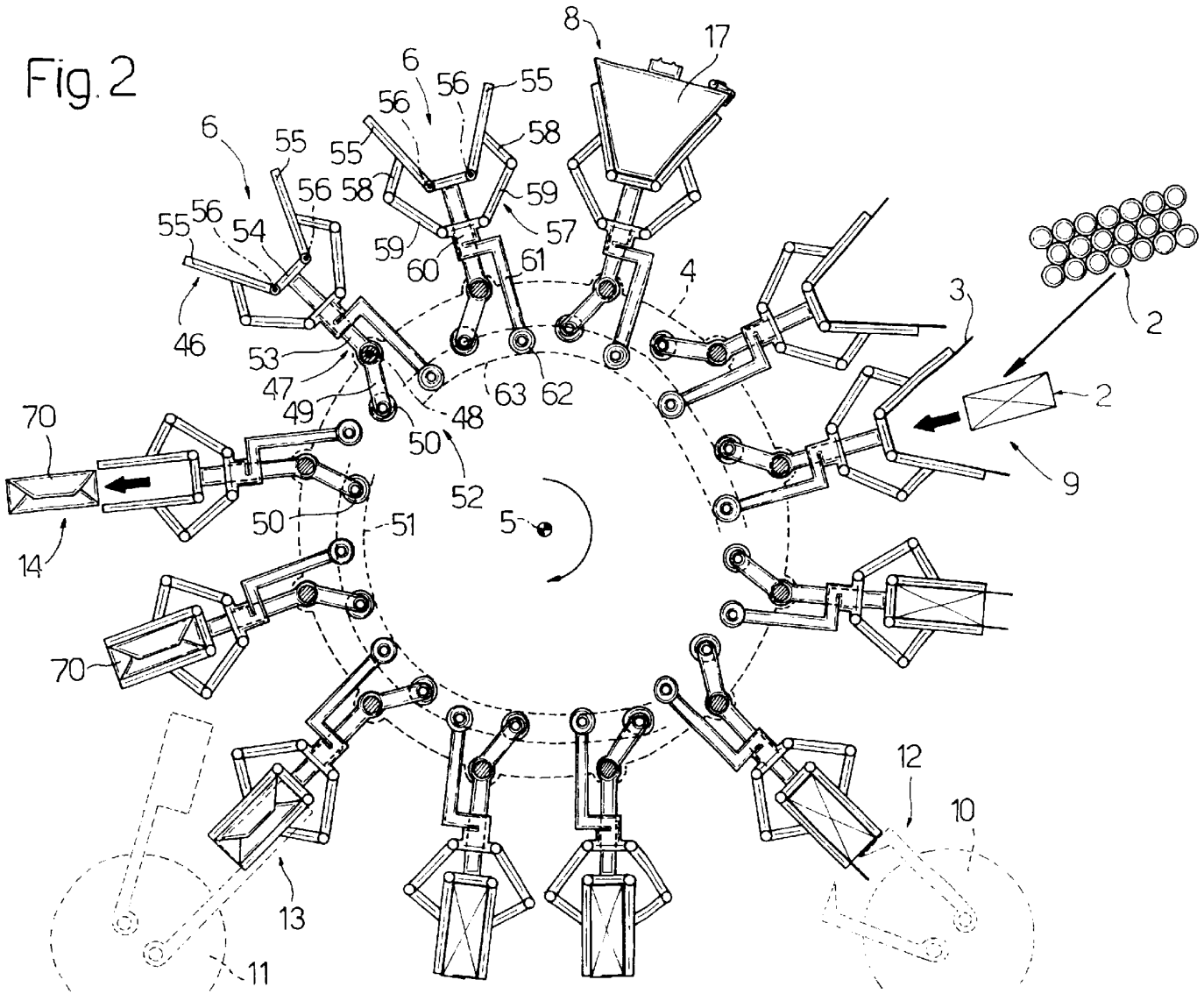
FIG. 2 shows a larger-scale schematic front view of a first detail of the FIG. 1 machine.

As shown more clearly in FIG. 2, each seat 6 is defined on a respective support 46 connected to wrapping wheel 4 via the interposition of a respective rocker arm 47 hinged to wrapping wheel 4 to swing, with respect to wrapping wheel 4, about an axis 48 parallel to axis 5. Each rocker arm 47 comprises a first arm 49 extending towards axis 5 and fitted on the free end with a tappet roller 50 connected to a fixed cam 51 defining, with roller 50, a control device 52 for controlling the angular position of rocker arm 47 about respective axis 48; and a second arm 53 extending outwards of wrapping wheel 4 and fitted on the free end with a respective support 46.

Each seat 6 in respective support 46 is defined by a bottom wall 54 fitted to respective arm 53, and by two lateral walls 55 hinged on opposite sides of wall 54 to swing, about respective axes 56 parallel to axis 5, between an open position and a closed position. In the open position, the two lateral walls 55 of each seat 6 form an obtuse angle with bottom wall 54, and the section of seat 6 is in the form of an isosceles trapezium negatively reproducing the shape of folding spindle 17. In the closed position, the two lateral walls 55 of each seat 6 form a substantially right angle with bottom wall 54, and seat 6 has a substantially rectangular section of substantially the same dimensions as a group 2 of cigarettes.

The angular position of lateral walls 55 about respective axes 56 is controlled by a control device 57 comprising two first arms 58, each of which has one end fitted to a respective lateral wall 55, and the other end hinged to one end of a second arm 59. The other end of each arm 59 is hinged to a tubular body 60, which slides along respective arm 53 and comprises an appendix 61, to the free end of which is hinged a tappet roller 62 connected to a fixed cam 63 to control the sliding movement of body 60 along respective arm 53.

The inner surfaces of walls 54 and 55 comprise a number of holes (not shown) connected to a known suction device (not shown) carried by wrapping wheel 4.

As shown more clearly in FIG. 4, folding device 10 comprises a cylinder 64 rotating about a fixed axis 65 parallel to axis 5; and a pair of folding elements 66 hinged to cylinder 64, and which are swung by a known cam control device (not shown) to fold a sheet 3 of wrapping material longitudinally about a respective group 2 of cigarettes.

As shown more clearly in FIG. 5, folding device 11 comprises a cylinder 67 rotating about a fixed axis 68 parallel to axis 5; and two pairs of folding elements 69 (only one shown in FIG. 5) hinged to cylinder 67, and which are swung by a known cam control device (not shown) to fold both ends (only one shown in FIG. 5) of a sheet 3 of wrapping material about a respective group 2 of cigarettes.

Operation of packing machine 1 will now be described with reference to one folding spindle 17 and one corresponding seat 6, and as of the instant in which folding spindle 17 is brought into supply station 19 by transfer wheel 15 rotating about axis 16.

Before being fed from supply unit 18 to folding spindle 17, sheet 3 of wrapping material is embossed in known manner by embossing rollers 25, and is worked by a first pair of blades (not shown) on cutting rollers 28, which form on sheet 3 said preformed tear line (not shown).

As shown more clearly in FIG. 3, as folding spindle 17 enters supply station 19, the lateral surface 38 of spindle 17 contacts sheet 3 of wrapping material, which is retained on lateral surface 38 by the suction generated by suction device 41, which is activated before folding spindle 17 enters supply station 19. At the same time, gripper 45 is also activated to retain sheet 3 of wrapping material on lateral surface 38. Suction device 41 and gripper 45 perform substantially the same function, which is that of retaining sheet 3 of wrapping material on lateral surface 38. In alternative embodiments not shown, gripper 45 or suction device 41 is dispensed with.

Sheet 3 of wrapping material, still integral with strip 21, is drawn out of supply unit 18 by folding spindle 17 rotating continuously about axis 16, is wound about folding spindle 17, and is folded substantially into an L about the edge 40 defined between surfaces 37 and 38, and therefore also onto surface 37, from which a rear portion of sheet 3 of wrapping material projects rearwards and is substantially coplanar with the intermediate portion of sheet 3 contacting surface 37.

Once extracted to substantially its full length, sheet 3 of wrapping material is detached in known manner from the rest of foil strip 21 by a second pair of blades (not shown) on cutting rollers 28, and is transferred by folding spindle 17 to loading station 8. Between supply station 19 and loading station 8, sheet 3 of wrapping material is engaged by folding element P, which assists in retaining sheet 3 of wrapping material on front edge 40 and top surface 37.

All the way between unloading station 14 and loading station 9. i.e. through the whole of loading station 8, control device 57 keeps seat 6 in said open position.

On nearing loading station 8, folding spindle 17 and corresponding seat 6 are swung by respective control devices 34 and 52 about respective axes 30 and 48 in advance with respect to transfer wheel 15 and wrapping wheel 4 respectively; which advanced swings are continued until folding spindle 17 is positioned substantially facing seat 6 and begins penetrating and gradually meshing with seat 6 in substantially the same way as a gear tooth. At this point, to keep folding spindle 17 and seat 6 facing each other and complete insertion of folding spindle 17 inside seat 6, control devices 34 and 52 begin delaying folding spindle 17 with respect to transfer wheel 15 and seat 6 with respect to wrapping wheel 4.

As it is inserted inside seat 6, folding spindle 17 folds the rear portion of sheet 3 about the rear edge 40 and so folds sheet 3 into a U onto lateral walls 55 of seat 6. In particular, folding spindle 17 and seat 6 act as a punch and die respectively to effectively fold sheet 3 of wrapping material without subjecting sheet 3 to excessive mechanical stress possibly resulting in partial or total tearing of said tear-off portion (not shown) of sheet 3. An important, though not essential, role in reducing mechanical stress on sheet 3 is played by the outer layer 44 of deformable material of folding spindle 17.

As top surface 37 of folding spindle 17 substantially contacts bottom wall 54 of seat 6, the suction through holes 42 in folding spindle 17 is cut off, and the suction through the holes (not shown) in seat 6 is activated so as to release sheet 3 of wrapping material inside, and adhering pneumatically to, seat 6.

Once sheet 3 is loaded, folding spindle 17 disengages seat 6, which is fed, by wrapping wheel 4 rotating continuously, from loading station 8 to loading station 9, where seat 6 receives a respective group 2 of cigarettes from a known supply conveyor (not shown).

Once group 2 is loaded, control device 57 sets seat 6 to said closed position to retain the whole formed by group 2 and by sheet 3 folded into a U about group 2. Seat 6 is then fed through folding stations 12 and 13 where, in known manner, folding devices 10 and 11 provide respectively for longitudinally folding and folding the ends of sheet 3 about group 2 to form about group 2 a wrapping 70. Finally, seat 6 is fed through unloading station 14 where the whole defined by group 2 and by wrapping 70 is fed in known manner to a known follow-up wrapping unit (not shown).

The above operations are repeated cyclically.

In an alternative embodiment not shown, sheet 3 of wrapping material, once extracted from supply unit 18, is wound about folding spindle 17 and folded substantially into a U onto lateral surfaces 38, 39 and top surface 37 of folding spindle 17.

What is claimed is:

1. A method of continuously wrapping a product, the method comprising the steps of feeding a sheet (3) of wrapping material to an output (19) of a line (18) for supplying wrapping material (21); coupling said sheet (3) with a folding spindle (17), about which said sheet (3) is folded at least partly into a U; feeding said folding spindle (17) together with said sheet (3) to a first loading station (8); inserting, at said first loading station (8) said folding spindle (17) into a seat (6) on a wrapping conveyor (4) for feeding the sheet (3) arranged in a substantially U-folded configuration inside said seat (6), said seat (6) being defined by a bottom wall (54) and by two lateral walls (55); feeding the seat (6) and the sheet (3) through a second loading station (9) to receive said product (2); and feeding the seat (6) together with the sheet (3) and the product (2) through at least one folding station (12, 13) to fold said sheet (3) about said product (2); the method being characterized in that said seat (6) is set in a first open position, in which each of the said lateral walls (55) forms with said bottom wall (54) an obtuse angle, to receive said sheet (3) and said product (2) and in a second closed position, in which each of the said lateral walls (55) forms with said bottom wall (54) a substantially right angle, to hold together said sheet (3) and said product (2) during the folding of the sheet (3) about the product (2).

2. A method as claimed in claim 1, wherein the spindle (17) is inserted inside the seat (6) by causing the spindle (17) to mesh gradually with the seat (6).

3. A method as claimed in claim 1, wherein said sheet (3) is punched in said seat (6) by said folding spindle (17), which is so formed as to negatively reproduce the shape of at least a portion of said seat (6) when said seat (6) is in said first open position.

4. A method as claimed in claim 1, wherein the sheet (3) is folded into a U in two successive steps, of which a first step comprises folding the sheet (3) into an L about the spindle (17) as the spindle (17) travels between said output (19) and said first loading station (8), and a second step is performed by inserting the spindle (17) inside said seat (6).

5. A method as claimed in claim 4, wherein said sheet (3) is folded about said spindle (17) by winding the sheet (3) gradually about the spindle (17).

6. A method as claimed in claim 1, wherein said spindle (17) and said seat (6) are kept facing each other as the spindle (17) is inserted inside the seat (6).

7. A method as claimed in claim 6, wherein said spindle (17) is carried by a rotary support (15) rotated continuously about a fixed axis (16).

8. A method as claimed in claim 7, wherein said spindle (17) is kept facing said seat (6) by imparting to the spindle (17) a first movement with respect to said support (15), and by simultaneously imparting to the seat (6) a second movement with respect to said wrapping conveyor (4).

9. A method as claimed in claim 8, wherein said first movement and said second movement are oscillations about respective axes (30, 48) movable with said support (15) and said wrapping conveyor (4) respectively.

10. A method as claimed in claim 1, wherein said spindle (17) is substantially trapezoidal and defined by an inclined first and second lateral surface (38, 39) located respectively at the front and rear in a traveling direction of the spindle (17) past said output (19), and by an intermediate third surface (37); said sheet (3) being folded about said spindle (17) by adhering first to said first lateral surface (38) and then to said intermediate third surface (37).

11. A machine for continuously wrapping a product, the machine comprising a line (18) for supplying wrapping material (21) and having an output (19); at least one seat (6) defined by a bottom wall (54) and by two lateral walls (55) for receiving and conveying said sheet (3) of wrapping material and a respective product (2); a wrapping conveyor (4) carrying said seat (6) and having a first loading station (8) for a sheet (3) of wrapping material, a second loading station (9) for said product (2), located downstream from said first loading station (8) in a traveling direction of said seat (6), and at least one folding station (12, 13) to fold said sheet (3) about said product (2); at least one folding spindle (17); and first actuating means (15) for feeding the folding spindle (17) through said output (19) to pick up and fold said sheet (3) of wrapping material at least partly into a U about the folding spindle (17), and then through said first loading station (8) to insert said folding spindle (17) into said seat (6) for feeding the sheet (3) arranged in a substantially U-folded configuration inside said seat (6); the machine being characterized in that said two lateral walls (55) are rotary connected to said bottom wall (54); the machine further comprising second actuating means (57) for setting said seat (6) in a first open position, in which each of the said lateral walls (55) forms with said bottom wall (54) an obtuse angle, to receive said sheet (3) and said product (2) and in a second closed position, in which each of the said lateral walls (55) forms with said bottom wall (54) a substantially right angle, to hold together said sheet (3) and said product (2) during the folding of the sheet (3) about the product (2).

12. A machine as claimed in claim 11, wherein said folding spindle (17) is so formed as to negatively reproduce the shape of at least a portion of said seat (6), when said seat (6) is in said first open position, for punching said sheet (3) in said seat (6).

13. A machine as claimed in claim 11, wherein said folding spindle (17) is substantially trapezoidal and defined by an inclined first and second lateral surface (38, 39) located respectively at the front and rear in a traveling direction of the folding spindle (17) past said output, and by an intermediate third surface (37).

14. A machine as claimed in claim 13, wherein said folding spindle (17) comprises a gripper (45) to retain said sheet (3) of wrapping material on said first lateral surface (38).

15. A machine as claimed in claim 13, wherein at least said first lateral surface and said intermediate third surface (38, 37) comprise pneumatic gripping means (41).

16. A machine as claimed in claim 11, wherein said wrapping conveyor (4) is a wrapping wheel (4) rotating about a fixed first axis (5); said first actuating means (15) comprising a powered support (15) rotating about a fixed second axis (16) parallel to the first axis (5).

17. A machine as claimed in claim 16, wherein first articulated connecting means (29) are interposed between said folding spindle (17) and said support (15) to guide the folding spindle (17) as the folding spindle is oscillated about a third axis (30) parallel to said second axis (16).

18. A machine as claimed in claim 17, wherein said first articulated connecting means (29) comprise a first arm (35), and a first hinge coaxial with said third axis (30) and connecting said first arm (35) to said support (15); first control means (34) being provided to control an angular position of the first arm (35) about the third axis (30).

19. A machine as claimed in claim 16, wherein said wrapping wheel (4) comprises at least one head (46) in which said seat (6) is defined; second articulated connecting means (47) being provided to connect said head (46) to said wrapping wheel (4).

20. A machine as claimed in claim 19, wherein said second articulated connecting means (47) comprise a second arm (53), and a second hinge having a fourth axis (48), parallel to said first axis (5), and connecting said second arm (53) to said wrapping wheel (4); second control means (52) being provided to control an angular position of the second arm (53) about the fourth axis (48).

21. A machine as claimed in claim 11, wherein said folding spindle (17) has an external surface (36, 37, 38, 39) defined by an outer layer (44) of deformable material.

* * * * *